United States Patent [19]

Keglewitsch et al.

[11] Patent Number: 4,971,582

[45] Date of Patent: Nov. 20, 1990

[54] FUSE CLIP REJECT MEMBER

[75] Inventors: Josef Keglewitsch, Bowling Green; Don R. Hubbard, Toledo, both of Ohio

[73] Assignee: Marathon Electric Manufacturing Corporation, Wausau, Wis.

[21] Appl. No.: 244,941

[22] Filed: Sep. 15, 1988

[51] Int. Cl.[5] ..... H01R 4/48

[52] U.S. Cl. ..... 439/831; 439/832

[58] Field of Search ..... 439/830–833

[56] References Cited

U.S. PATENT DOCUMENTS

| | | | |
|---|---|---|---|
| 1,025,245 | 5/1912 | Cole | 439/830 |
| 2,011,391 | 8/1935 | Bennett . | |
| 2,942,228 | 6/1960 | Swick . | |
| 2,943,295 | 6/1960 | Stewart . | |
| 2,958,020 | 10/1960 | Eannarino . | |
| 3,890,032 | 6/1975 | Tillson . | |
| 3,914,005 | 10/1975 | Tillson . | |
| 3,927,929 | 12/1975 | Puetz | 439/831 |
| 3,960,435 | 6/1976 | Bailey et al. . | |
| 3,984,801 | 10/1976 | Mrenna et al. . | |
| 4,017,816 | 4/1977 | Latimer | 439/831 |
| 4,097,114 | 6/1978 | Motten, Jr. . | |
| 4,178,063 | 12/1979 | Reynolds . | |
| 4,257,662 | 3/1981 | Motten, Jr. . | |
| 4,278,316 | 7/1981 | White . | |
| 4,547,036 | 10/1985 | Keglewitsch et al. . | |

FOREIGN PATENT DOCUMENTS 1043480 11/1958 Fed. Rep. of Germany .

*Primary Examiner*—David L. Pirlot

*Attorney, Agent, or Firm*—Andrus, Sceales, Starke and Sawall

[57] ABSTRACT

A reject type fuse clip for use with a cartridge type fuse having a grooved ferrule includes a fuse clip having a pair of upstanding clamping arms and a reject member disposed therebetween. The upstanding clamping arms of the fuse clip are provided with a receptor means, such as a web formed therein by a pair of slots, which is adapted for engagement by the reject member. The reject member includes a pair of spaced shoulder portions, with each shoulder portion having a slot in its underside adapted to engage the web members provided on each upstanding clamping arm of the fuse clip. The slots are configured so that the web member flexes during insertion into the slot, after which the reject member may not be removed from the fuse clip without damage to either the reject member or the fuse clip. A lead connecting collar is formed integrally with the fuse clip.

31 Claims, 2 Drawing Sheets

FUSE CLIP REJECT MEMBER

BACKGROUND OF THE INVENTION

The present invention relates to fuse clips for cartridge fuses, and more particularly to fuse clips incorporating means for preventing insertion of an improper fuse into the fuse clip.

It is known to use a reject member for placement within a fuse clip. Such a reject member generally extends across the fuse holding cavity defined by the upstanding resilient clamping arms of the fuse clip. The reject member is adapted to receive a groove provided in the ferrule of a cartridge type fuse. The reject member serves the purpose of preventing the insertion of an incorrectly sized fuse into the fuse clip, by rejecting any fuse which does not have the appropriate groove in its ferrule.

Previous reject-type fuse clips have incorporated a reject member which is retained in place on the fuse clip by means of slots selectively positioned in the clamping arms of the fuse clip. The upstanding sides of the reject member mate with such slots when the clamping arms are bent into position during formation of the fuse clip.

SUMMARY OF THE INVENTION

The present invention provides a reject member which can be retrofit into an existing fuse clip, and which need not be incorporated during formation of the fuse clip. The reject member of the invention is adapted for placement transversely in the fuse holding cavity defined by the upstanding clamping arms of the fuse clip. Each upstanding clamping arm is provided with a receptor means, such as a web formed by a pair of aligned slots. The reject member includes engagement means adapted for push-on engagement with the receptor means provided in each clamping arm of the fuse clip. In a particular, practical and unique embodiment, the reject member has a pair of spaced shoulders, and includes a rounded or U-shaped groove-receiving surface between the spaced shoulders. Each clamp arm has a web member formed by a pair of aligned slots and each shoulder is provided with the engagement means for engaging the web in the clamping arm. The engagement means may, for example, be a slot disposed in the underside of each shoulder portion of the reject member. The slots are configured so that the reject member may be engaged with the fuse clip using a push-on motion in substantially the same direction as the push-on motion used to insert a fuse into the fuse holding cavity of the fuse clip. Each slot is adapted to receive the web member provided on each upstanding clamping arm of the fuse clip. The slots are configured so that, after engagement of the web member within the slot, the reject member may not thereafter be removed without damaging the fuse clip or the reject member.

BRIEF DESCRIPTION OF THE DRAWINGS

The drawings illustrate the best mode presently contemplated of carrying out the invention.

In the drawings.

DETAILED DESCRIPTION OF THE ILLUSTRATED EMBODIMENT

Figure 1:
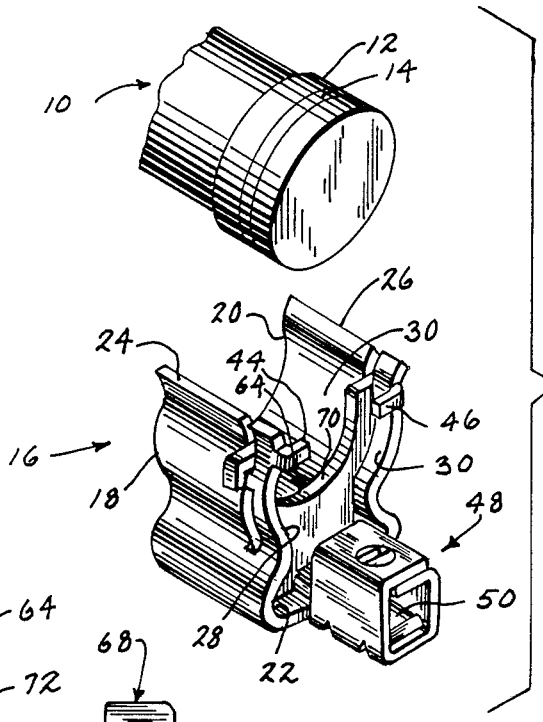
FIG. 1 is a perspective view of a fuse clip with the reject member of the present invention installed within the fuse holding cavity of the fuse clip, and also showing a fuse with a grooved ferrule adapted for insertion in the fuse clip.

As shown in FIG. 1, a cartridge type fuse 10 is provided at one end with a ferrule 12 having a circumferential groove 14. Fuse 10 extends generally along a longitudinal fuse axis.

Figure 2:
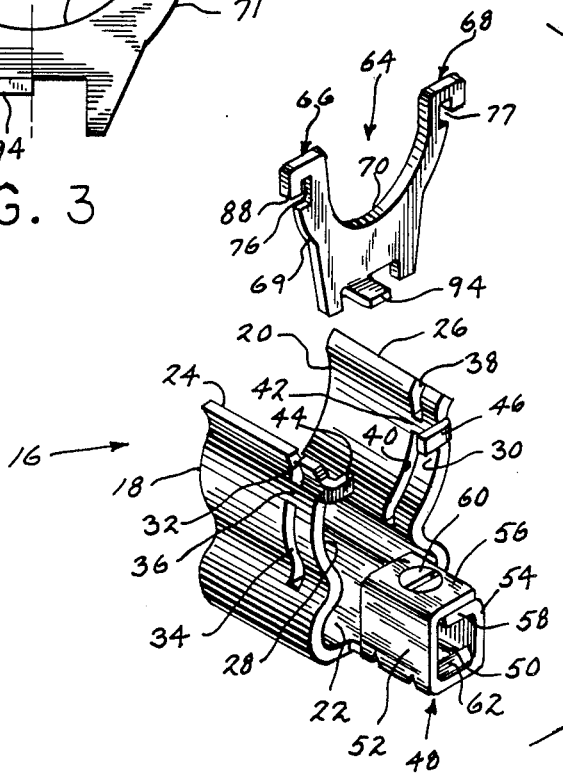
FIG. 2 is an exploded perspective view showing the reject member of the present invention prior to engagement with a fuse clip.

Referring to FIG. 2, a fuse clip 16 is adapted to receive ferrule 12 of fuse 10, and is provided with a pair of upstanding clamping arms 18, 20 extending from a base 22. Upstanding clamping arms 18, 20 have outer tips 24, 26 which define a fuse receiving opening. Each clamping arm 18, 20 is provided with a fuse contact surface 28, 30, respectively. The fuse-receiving opening defined by outer tips 24, 26 of clamping arms 18, 20 leads to a fuse-holding cavity disposed between fuse contact surfaces 28, 30, respectively.

Upstanding clamping arm 18 is provided with a slot 32 extending from its outer tip 24 downwardly toward base 22 and terminating at fuse contact surface 28 of upstanding clamping arm 18. Clamping arm 18 is further provided with a second slot 34, which extends from a point spaced from the terminus of slot 32 downwardly toward base 22 of fuse clip 16 and terminates at a point spaced upwardly from base 22. Slots 32 and 34 are in substantial alignment with each other, and are disposed generally perpendicularly to base 22 and outer tip 24 of clamping arm 18. A web 36 is formed in fuse contact surface 28 by the area remaining between slots 32 and 34.

Similarly, clamping arm 20 is provided with a slot 38 extending perpendicularly from outer tip 26 of clamping arm 20 toward base 22 and terminating at fuse contact surface 30. A second slot 40 aligned with slot 38 extends from a point adjacent the terminus of slot 38 toward base 22 and terminates at a point spaced upwardly from base 22. A web 42 is thereby formed in fuse contact surface 30 of clamping arm 20 by the area of clamping arm 20 remaining between slots 38 and 40.

The ends of each clamping arm 18, 20 are provided with tabs 44, 46, respectively. Tabs 44 and 46 are adapted to abut the end of ferrule 12 when inserted within fuse clip 16, to properly locate fuse 10 for insertion within fuse clip 16.

A lead connecting collar 48 is connected integrally with base 22 of fuse clip 16. Lead connecting collar 48 includes a lead base 50 having a pair of upstanding side walls 52, 54 extending therefrom. Top overlapping walls 56, 58 are provided at the upper ends of side walls 52, 54, respectively. Walls 52–58 are formed from a pair of collar arms extending from lead base 50 which are wrapped from lead base 50 to form a tubular collar having overlapping wall portions. A lead connector screw 60 extends through a threaded opening provided in each of top overlapping walls 56, 58. Lead base 50 includes one or more inverted V-shaped lead engaging spikes 62, which are adapted to cooperate with lead engaging screw 60 to retain an electrical lead (not shown) within the lead receiving opening of collar 48.

Figure 3:
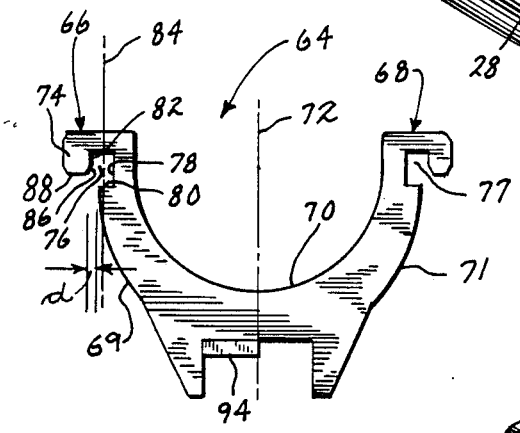
FIG. 3 is a front elevation view of a reject member constructed according to the present invention.

A reject member 64 is adapted to fit within the fuse-holding cavity between fuse contact surfaces 28, 30 of upstanding clamping arms 18, 20, respectively, as shown in FIGS. 1–3. Reject member 64 is adapted to be engaged with fuse clip 16 using a downward push-on motion in substantially the same direction used for insertion of fuse 10 into fuse clip 16. Reject member 64 is disposed substantially transverse to the longitudinal axis of fuse 10, and is adapted to mate with circumferential groove 14 in ferrule 12 of fuse 10 when ferrule 12 is inserted in fuse clip 16.

As shown in FIG. 1, slots 32, 34 and 38, 40 in clamping arms 18, 20 are of a width sufficient to accommodate the entry of reject member 64 therein, and act to snugly retain and prevent lateral movement of reject member 64 after its insertion into fuse clip 16.

The upper portion of reject member 64 is substantially symmetrical about a central axis of symmetry 72, as shown in FIG. 3, which is substantially perpendicular to the plane of base 22 of fuse clip 16 when reject member 64 is inserted therein. Reject member 64 includes a pair of spaced shoulder portions 66, 68. A rounded or U-shaped curved surface 70 spans between shoulder portions 66, 68, and is adapted to receive and engage groove 14 in ferrule 12 of fuse 10. The outwardly facing edges of reject member 64 are formed into camming surfaces 69, 71, the function of which will be explained.

Shoulder portion 66 is provided with a depending arm 74. The side of reject member 64 facing arm 74 is provided with a notch, which forms a side 78 and bottom 80 of a slot 76 disposed in the underside of shoulder portion 66. Slot 76 opens downwardly and outwardly away from shoulder portion 66, and is laterally offset from a longitudinal slot axis 84. The inner side of depending arm 74 forms a side 82 of slot 76. Side 82 of slot 76 is disposed outwardly with respect to the uppermost point of camming surface 69 leading to slot 76, shown in FIG. 3 as dimension "d". Dimension "d" of the opening into slot 76 is perpendicular to the longitudinal axis 84 of slot 76. Dimension "d" is less than the corresponding width of web 36 in upstanding clamping arm 18.

A diagonal surface 86 is disposed between side 82 of slot 76 and a lower edge 88 of depending arm 74 to form a ramp leading into slot 76. Lower edge 88 of depending arm 74 is disposed above bottom surface 80 of slot 76.

Due to symmetry in the upper portion of reject member 64 about axis 72, shoulder portion 68 includes a slot 77 indentical to slot 76 formed in shoulder portion 66.

Figure 4:
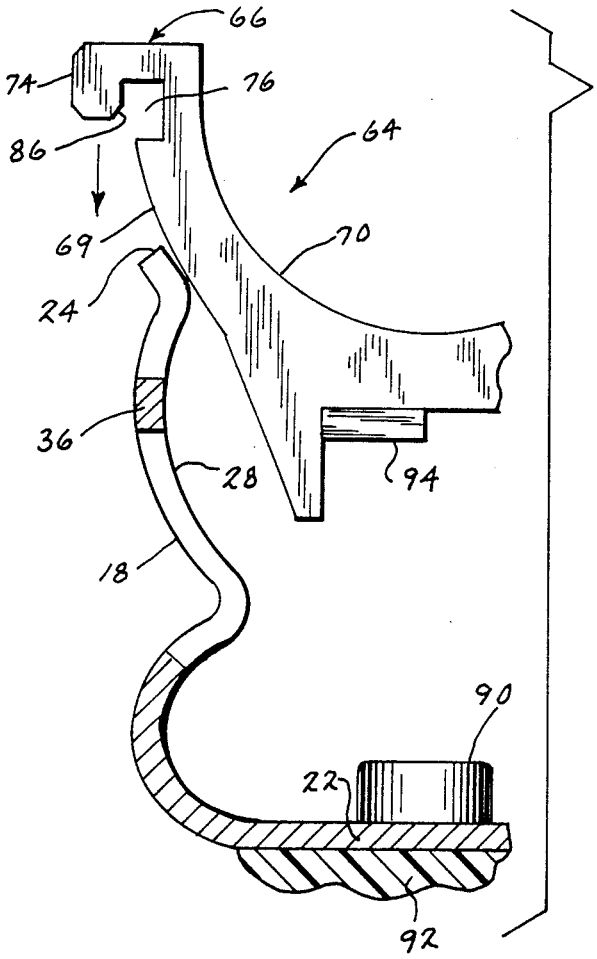
FIG. 4 is a partial sectional view showing the reject member of the present invention and fuse clip prior to engagement of the reject member with the fuse clip.
Figure 5:
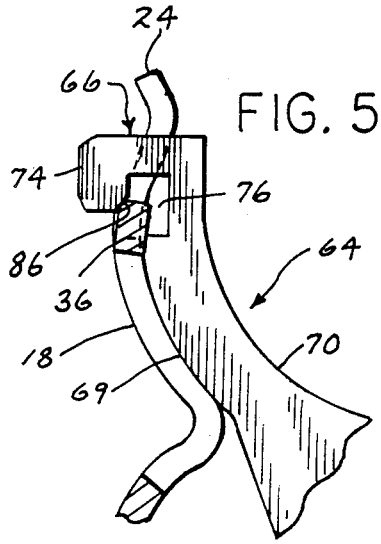
FIG. 5 is a view similar to FIG. 4 showing engagement of the reject member of the present invention with a fuse clip.
Figure 6:
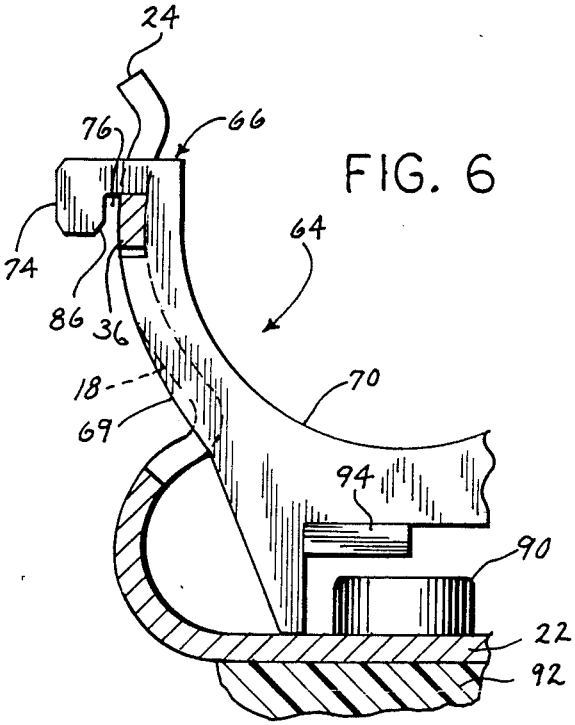
FIG. 6 is a view similar to FIG. 4, showing the reject member of the invention after engagement with a fuse clip.

FIGS. 4–6 illustrate the sequence of insertion of reject member 64 into fuse clip 16. It should be recognized that FIGS. 4–6 show only one side of reject member 64 during its insertion into fuse clip 16, and that a similar sequence takes place at the other side of reject member 64.

With reference to FIGS. 4–6, it is seen that during downward insertion of reject member 64 into the fuse-holding cavity between fuse contact surfaces 28, 30, camming surface 69 of reject member 64 first comes into contact with web member 36 of clamping arm 18. As downward insertion of reject member 64 continues, camming surface 69 acts to flex clamping arm 18 outwardly as web member 36 follows the contour of camming surface 69. As shown in FIG. 4, web member 36 is then introduced into the opening leading into slot 76. As shown in FIG. 4, and with reference to its orientation, the top left corner of web member 36 then engages ramp 86 formed in depending arm 74 of shoulder 66, and the right side of web 36 engages the topmost point of camming surface 69 leading to slot 76. With the continued application of downward force exerted on reject member 64, the top of web member 36 moves upwardly along ramp 86 and is deformed from its original position and flexes clockwise to snap into slot 76. After snapping into slot 76, web member 36 returns to its original position. Thereafter, due to the configuration of slot 76 and its relation to web member 36, web member 36 may not be removed from slot 76 without deformation of either reject member 64 or upstanding clamping arm 18. This is in compliance with applicable U.L. safety standards, which require that removal of a reject member without destruction of the fuse clip should not be possible with standard hand tools.

After reject member 64 has been inserted in fuse clip 16, reject member 64 acts to displace clamping arms 18, 20 outwardly by a small amount, to pre-load fuse clip 16. This pre-loading of fuse clip 16 reduces the amount of force needed to insert fuse 10 into fuse clip 16, but does not affect the amount of holding pressure exerted by clamping arms 18, 20 on ferrule 12 of fuse 10.

Reject member 64 also acts to limit outward flexing by clamping arms 18, 20. That is, with reference to FIG. 6, web 36 is only capable of outward movement up to the point of engagement of web 36 with side 82 of depending arm 74. Further outward movement of clamping arm 18 is prevented by engagement of web 36 with arm 74. This limitation of outward flexing of clamping arms 18, 20 ensures that a fuse having a ferrule with too large a diameter is not accepted by fuse clip 16. Additionally, because dimension "d" of the opening into slot 76 is smaller than the width of web 36, reject member 64 may not be removed from fuse clip 16 even upon maximum outward flexing of clamping arms 18, 20.

Figure 7:
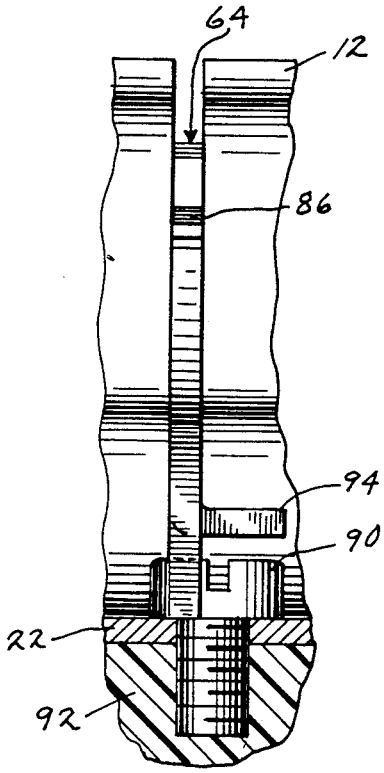
FIG. 7 is a side view of the reject member of the present invention, showing its relation to a mounting screw for mounting a fuse clip onto a support.

As shown in FIG. 7, reject member 64 may be inserted in fuse clip 16 in the vicinity of one or more mounting screws 90, which mount fuse clip 16 to an underlying support structure 92. A leg 94 extends outwardly from the plane of reject member 64, and covers at least a portion of the head of mounting screw 90 Leg 94 is adapted to interfere with access to the head of mounting screw 92, for providing a tamper resistant feature to fuse clip 16.

As can be seen, the unique geometry of shoulder portion 66 in relation to web member 66 allows reject member 64 to be firmly engaged with fuse clip 16, and makes removal of reject member 64 very difficult once in place. Such a configuration allows the reject member to be retrofit into existing fuse clips, if desired, to bring such clips into compliance with safety standards. The present invention also allows fuse clip 16 to be used as a non-reject clip to accept a standard ferrule type fuse without a groove. That is, reject member 64 need only be installed as required, and may be retrofit into existing fuse clips. In direct contrast to prior reject member structures, the present invention allows the provision of a reject member which need not be part of the original formation of the fuse clip.

Various alternatives are contemplated as being with in the scope of the following claims particularly pointing out and distinctly claiming the subject matter regarded as the invention.

We claim:

1. For a fuse clip for use with a ferrule type fuse, said fuse clip including a base having a pair of opposed upstanding clamping arms each having an outer tip so as to define a fuse receiving opening therebetween leading to a fuse-holding cavity between facing fuse contact surfaces provided on said clamping arms adapted to receive said fuse, said fuse extending along a fuse axis and having a grooved ferrule at one end and being adapted for insertion into said fuse-holding cavity by use of a push-on motion transverse to said fuse axis, each said clamping arm being provided with a first slot extending inwardly from the outer tip of said clamping arm and terminating at a point adjacent said fuse-holding cavity, and a second slot extending inwardly from a point adjacent the terminus of said first slot, to form a resilient web member therebetween, a reject member adapted for placement transversely into said fuse holding cavity between said clamping arms for receiving said groove in said fuse ferrule, said reject member including locking means and being adapted for engagement with the clamping arms provided on said fuse clip in response to insertion of said reject member into said fuse-holding cavity, wherein said locking means engages the resilient web members provided on said clamping arms during push-on insertion of said reject member into said fuse-holding cavity and said resilient web members deflect from their original position during said push-on insertion of said reject member and return to their original position after said push-on insertion to interlock with the locking means provided on said reject member to prevent removal thereof from said fuse clip.

2. The reject member of claim 1, wherein said reject member is adapted for push-on insertion into said fuse-holding cavity in substantially the same direction of push-on insertion of said fuse into said fuse-holding cavity of said fuse clip.

3. The reject member of claim 1, wherein said first and second slots in each said clamping arm are in substantial alignment with each other in a direction from the outer tip of said clamping arm toward said base of said fuse clip.

4. The reject member of claim 1, wherein said reject member is substantially symmetrical about an axis of symmetry and includes a pair of spaced shoulder portions disposed at the sides of said reject member with a groove receiving surface disposed therebetween and adapted to open into said fuse-holding cavity for receiving said groove in said fuse ferrule, and wherein said locking means adapted for push-on engagement with said resilient web members is provided on said shoulder portions of said reject member.

5. The reject member of claim 4, wherein each said shoulder of said reject member is provided with a slot in its underside having an opening adapted to receive said resilient web member during said push-on engagement of said reject member with said fuse clip.

6. The reject member of claim 5, wherein said slot opening is laterally offset from a longitudinal slot axis disposed parallel to said axis of symmetry of said reject member, and wherein said slot opening has a dimension perpendicular to said longitudinal slot axis less than the corresponding dimension of said web member.

7. The reject member of claim 6, wherein each said shoulder portion is provided with a depending arm spaced from the outer side of said reject member and disposed generally parallel to said axis of symmetry of said reject member, said depending arm having an edge forming a side of said slot.

8. The reject member of claim 7, wherein said edge of said depending arm forming a side of said slot acts to limit outward displacement of said clamping arm after said web is lodged within said slot due to engagement of said web with said edge of said depending arm during outward flexing of said clamping arm.

9. The reject member of claim 7, wherein said outer side of said reject member spaced from said depending arm is provided with a notch having a bottom surface forming the bottom of said slot, and wherein the lower end of said depending arm terminates at a point above the bottom of said slot.

10. The reject member of claim 9, wherein said depending arm includes a diagonal surface leading form the lower end of said arm to the side of said arm facing said side of said reject member to thereby form a ramp leading into said slot, and wherein said web member engages said ramp during said push-on engagement of said reject member therewith so as to cause said web member to flex during said push-on engagement for allowing entry of said web member into said slot, said web member returning to its original position after entry into said slot to thereby lock said web member into said slot.

11. For a fuse clip for use with a ferrule type fuse, said fuse clip including a base having a pair of opposed upstanding clamping arms having outer tips defining a fuse receiving opening leading to a fuse-holding cavity between facing fuse contact surfaces provided on said clamping arms adapted to receive said fuse, said fuse extending along a fuse axis and having a grooved ferrule at one end and being adapted for insertion into said fuse-holding cavity by use of a push-on motion transverse to said fuse axis, said fuse clip including receptor means disposed thereon and mounting means for mounting said fuse clip to a supporting surface, a reject member adapted for placement transversely in said fuse-holding cavity in the vicinity of said mounting means and between said clamping arms and adapted to receive said groove in said fuse ferrule, said reject member adapted for push-on engagement with said receptor means provided on said fuse clip in response to insertion of said reject member into said fuse-holding cavity, to affix said reject member to said fuse clip, said reject member including means for preventing tampering with said mounting means comprising a portion of said reject member offset from the plane of said reject member for providing a cover for at least a portion of said mounting means to impede access to said mounting means.

12. A reject type fuse clip for use with a ferrule type fuse extending along a fuse axis and having a grooved ferrule at one end, comprising:

a fuse clip member comprising a base having a pair of opposed upstanding clamping arms each having an outer tip as to define a fuse receiving opening therebetween leading to a fuse-holding cavity between facing fuse contact surfaces provided on said clamping arms adapted to receive said fuse, said fuse being adapted or insertion into said fuse-holding cavity by use of a push-on motion applied to said fuse transverse to said fuse axis, each said clamping arm being provided with a first slot extending inwardly from the outer tip of said clamping arm and terminating at a point adjacent said fuse-holding cavity, and is further provided with a second slot extending inwardly from a point adjacent the terminus of said first slot, to thereby form a resilient web member between said first and second slots; and a reject member adapted for placement transversely into said fuse-holding cavity between said clamping arms for receiving said groove in said fuse ferrule, said reject member including locking means and being adapted for engagement with the clamping arms provided on said fuse clip in response to insertion of said reject member into said fuse-holding cavity, wherein said locking means engages the resilient receptor members provided on said clamping arms during push-on insertion of said reject member into said fuse-holding cavity and said resilient web members deflect from their original position during said push-on insertion of said reject member and return to their original position after said push-on insertion to interlock with the locking means provided on said reject member to prevent removal thereof from said fuse clip.

13. The fuse clip of claim 12, wherein said reject member is adapted for push-on insertion into said fuse holding cavity in substantially the same direction of push-on insertion of said fuse into said fuse-holding cavity of said fuse clip.

14. The fuse clip of claim 12, wherein said reject member is substantially symmetrical about an axis of symmetry and includes a pair of space shoulder portions having a groove receiving surface disposed therebetween and adapted to open into said fuse-holding cavity for receiving said groove in said fuse ferrule, and wherein said locking means is provided on said shoulder portions of said reject member.

15. The fuse clip of claim 14, wherein each said shoulder portion is provided with a slot in its underside, said slot having an opening adapted to receive said web member during said push-on engagement of said reject member with said fuse clip.

16. The fuse clip of claim 15, wherein said slot opening is laterally offset from a longitudinal axis of said slot disposed parallel to said axis of symmetry of said reject member, and wherein said opening has a dimension perpendicular to said slot axis less than the corresponding dimension of said web member, and wherein each said shoulder portion of said reject member is provided with a depending arm spaced from the side of said reject member and disposed generally parallel to said axis of symmetry of said reject member, said depending arm having an edge forming a side of said slot, and wherein said side of said reject member spaced from said depending arm is provided with a notch having a bottom surface forming the bottom of said slot, and wherein the lower end of said depending arm terminates at a point above the bottom of said slot.

17. The fuse clip of claim 16, wherein said depending arm includes an inclined surface leading from the lower end of said arm to the side of said arm facing said side of said reject member to thereby form a ramp leading into said slot, and wherein said web member engages said ramp during push-on engagement of said reject member therewith so as to cause said web member to flex during said push-on engagement for allowing entry of said web member into said slot, said web member returning to its original position after entry into said slot to lock said web member into said slot.

18. The fuse clip of claim 16, wherein said edge of said depending arm forming a side of said slot acts to limit outward displacement of said clamping arm after said web is lodged within said slot due to engagement of said web with said edge of said arm during outward flexing of said clamping arm.

19. The fuse clip of claim 12, further comprising a lead connecting collar formed integrally with said fuse clip, said lead connecting collar being provided with a lead clamping means for clamping a lead in said collar.

20. The fuse clip of claim 19, wherein said lead connecting collar is formed from a pair of collar arms extending from a lead base, said collar arms being wrapped from the lead base to form a tubular collar having overlapping wall portions.

21. The fuse clip of claim 20, wherein said overlapping wall portions include aligned openings to receive a lead clamping screw for clamping a lead in said collar to said lead base.

22. For a fuse clip for use with a ferrule type fuse, said fuse clip including a base having a pair of opposed upstanding clamping arms having outer tips defining a fuse receiving opening leading to a fuse-holding cavity between facing fuse contact surfaces provided on said clamping arms adapted to receive said fuse, said fuse extending along a fuse axis and having a groove ferrule at one end and being adapted for insertion into said fuse-holding cavity by use of a push-on motion transverse to said fuse axis, said fuse clip including receptor means disposed thereon and comprising interlocking means including at least one resilient element disposed on one of said clamping arms, said resilient element comprising a web member formed by a first slot extending inwardly from the outer tip of said clamping arm and terminating at a point adjacent said fuse-holding cavity, and a second slot extending inwardly from a point adjacent the terminus of said first slot so as to form said web member between said first and second slots, a reject member adapted for placement transversely in said fuse-holding cavity between said clamping arms for receiving said groove in said fuse ferrule, said reject member including engagement means adapted for push-on engagement and interlocking with said web member provided on said fuse clip clamping arm in response to insertion of said reject member into said fuse-holding cavity, said web member being adapted to deflect from its original position during said push-on insertion of said reject member and to return to its original position after said push-on insertion to interlock with said reject member and to prevent removal thereof form said fuse clip.

23. The reject member of claim 22, wherein said first and second slots in each said clamping arm are in substantial alignment with each other in a direction from the outer tip of said clamping arm toward said base of said fuse clip.

24. For a fuse clip for use with a ferrule type fuse, said fuse clip including a base having a pair of opposed upstanding clamping arms having outer tips defining a fuse receiving opening leading to a fuse-holding cavity between facing fuse contact surfaces provided on said clamping arms adapted to receive said fuse, said fuse extending along a fuse axis and having a grooved ferrule at one end and being adapted for insertion into said fuse-holding cavity by use of a push-on motion transverse to said fuse axis, said fuse clip including receptor means disposed thereon and comprising interlocking means including at least one resilient web member on one of said clamping arms, a reject member adapted for placement transversely in said fuse-holding cavity between said clamping arms for receiving said groove in said fuse ferrule, said reject member including engagement means adapted for push-on engagement and interlocking with said web member provided on said fuse clip clamping arm in response to insertion of said reject member into said fuse-holding cavity, said web member being adapted to deflect from its original position during said push-on insertion of said reject member and to return to is original position after said push-on insertion to interlock with said reject member and to prevent removal thereof from said fuse clip, wherein said reject member is substantially symmetrical about an axis of symmetry and includes a pair of spaced shoulder portions disposed at the sides of said reject member with a groove receiving surface disposed therebetween and adapted to open into said fuse-holding cavity for receiving said groove in said fuse ferrule, and wherein said engagement means adapted for push-on engagement with said web member is provided on said shoulder portions of said reject member and comprises a depending arm spaced from the outer side of said reject member and disposed generally parallel to said axis of symmetry of said reject member, said depending arm having an edge forming a side of a slot formed in each said shoulder and providing an opening in the underside of said shoulder adapted to receive said web member during said push-on engagement of said reject member with said fuse clip, wherein said slot opening is laterally offset from a longitudinal slot axis disposed parallel to the axis of symmetry of said reject member, and wherein said slot opening has a dimension perpendicular to said longitudinal slot axis less that the corresponding dimension of said web member.

25. The reject member of claim 24, wherein said edge of said depending arm forming a side of said slot acts to limit outward displacement of said clamping arm after said web is lodged within said slot due to engagement of said web with said edge of said depending arm during outward flexing of said clamping arm.

26. The reject member of claim 24, wherein said outer side of said reject member spaced from said depending arm is provided with a notch having a bottom surface forming the bottom of said slot, and wherein the lower end of said depending arm terminates at a point above the bottom of said slot.

27. The reject member of claim 26, wherein said depending arm includes an diagonal surface leading from the lower end of said arm to the side of said arm facing said side of said reject member to thereby form a ramp leading into said slot, and wherein said web member engages said ramp during said push-on engagement of said reject member therewith so as to cause said web member to flex during said push-on engagement for allowing entry of said web member into said slot, said web member returning to its original position after entry into said slot to thereby lock said web member into said slot.

28. A reject type fuse clip for use with a ferrule type fuse extending along a fuse axis and having a grooved ferrule at one end, comprising:

a fuse clip member comprising a base having a pair of opposed upstanding clamping arms having outer tips defining a fuse receiving opening leading to a fuse-holding cavity between facing fuse contact surfaces provided on said clamping arms adapted to receive said fuse, said fuse clip having a receptor means disposed thereon comprising interlocking means including at least one resilient web member disposed on one of said clamping arms, said web member being formed by a first slot extending inwardly from the outer tip of said clamping arm and terminating at a point adjacent said fuse-holding cavity, and a second slot extending inwardly from a point adjacent the terminus of said first slot so as to form said web member between said first and second slots, wherein said fuse is adapted for insertion into said fuse-holding cavity by use of a push-on motion applied to said fuse transverse to said fuse axis; and a reject member adapted for placement transversely in said fuse-holding cavity between said clamping arms and adapted to receive said groove in said fuse ferrule, said reject member including engagement means adapted for push-on engagement and interlocking with said web member provided on said fuse clip in response to insertion of said reject member into said fuse-holding cavity for affixing said reject member to said fuse clip, said web member being adapted to deflect from its original position during said push-on insertion of said reject member and to return to its original position after said push-on insertion to interlock with said reject member engagement means and to prevent removal of said reject member from said fuse clip.

29. A reject type fuse clip for use with a ferrule type fuse extending along a fuse axis and having a grooved ferrule at one end, comprising:

a fuse clip member comprising a base having a pair of opposed upstanding clamping arms having outer type defining a fuse receiving opening leading to a fuse-holding cavity between facing fuse contact surfaces provided on said clamping arms adapted to receive said fuse, said fuse clip having a receptor means disposed thereon comprising interlocking means including at least one resilient web member disposed on one of said clamping arms, wherein said fuse is adapted for insertion into said fuse-holding cavity by use of a push-on motion applied to said fuse transverse to said fuse axis; and a reject member adapted for placement transversely in said fuse-holding cavity between said clamping arms and adapted to receive said groove in said fuse ferrule, said reject member including engagement means adapted for push-on engagement and interlocking with said web member provided on said fuse clip in response to insertion of said reject member into said fuse-holding cavity for affixing said reject member to said fuse clip, said web member being adapted to deflect from its original position during said push-on insertion of said reject member and to return to its original position after said push-on insertion to interlock with said reject member engagement means and to prevent removal of said reject member from said fuse clip, wherein said reject member is substantially symmetrical about an axis of symmetry and includes a pair of spaced shoulder portions having a groove receiving surface disposed therebetween and adapted to open into said fuse-holding cavity for receiving said groove in said fuse ferrule, and wherein said engagement means is provided on said shoulder portions of said reject member and comprises a slot having an opening formed in the underside of each said shoulder adapted to receive said web member, wherein said slot opening is laterally offset from a longitudinal axis of said slot disposed parallel to said axis of symmetry of said reject member, and wherein said opening has a dimension perpendicular to said slot axis less than the corresponding dimension of said web member, and wherein each said shoulder portion of said reject member is provided with a depending arm spaced from the side of said reject member and disposed generally parallel to said axis of symmetry of said reject member, said depending arm having an edge forming a side of said slot, and wherein said side of said reject member spaced from said depending arm is provided with a notch having a bottom surface forming the bottom of said slot, and wherein the lower end of said depending arm terminates at a point above the bottom of said slot.

30. The fuse clip of claim 29, wherein said depending arm includes an inclined surface leading from the lower end of said arm to the side of said arm facing said side of said reject member to thereby form a ramp leading into said slot, and wherein said web member engages said ramp during push-on engagement of said reject member therewith so as to cause said web member to flex during said push-on engagement for allowing entry of said web member into said slot, said web member returning to its original position after entry into said slot to lock said web member into said slot.

31. The fuse clip of claim 30, wherein said edge of said depending arm forming a side of said slot acts to limit outward displacement of said clamping arm after said web is lodged within said slot due to engagement of said web with said edge of said arm during outward flexing of said clamping arm.

* * * * *

UNITED STATES PATENT AND TRADEMARK OFFICE

CERTIFICATE OF CORRECTION

PATENT NO. : 4,971,582

DATED : November 20, 1990

INVENTOR(S) : Josef Keglewitsch et al

It is certified that error appears in the above-identified patent and that said Letters Patent is hereby corrected as shown below:

Claim 12, col 6, line 62:

Delete "or" and substitute therefor -- for --.

Claim 22, col 8, line 50:

Delete "form" and substitute therefor -- from --.

Claim 24, col 9, line 33:

Delete "that" and substitute therefor -- than --.

Claim 29, col 10, line 33:

Delete "type" and substitute therefor -- tips --.

UNITED STATES PATENT AND TRADEMARK OFFICE

CERTIFICATE OF CORRECTION

PATENT NO. : 4,971,582

DATED : November 20, 1990

INVENTOR(S) : Josef Keglewitsch et al.

It is certified that error appears in the above-identified patent and that said Letters Patent is hereby corrected as shown below:

Claim 29, col 10, line 33:

Delete "type" and substitute therefor -- tips --.

Signed and Sealed this

Sixteenth Day of June, 1992

*Attest:*

DOUGLAS B. COMER

*Attesting Officer*

*Acting Commissioner of Patents and Trademarks*